US008851157B2

(12) United States Patent
Falkingham et al.

(10) Patent No.: US 8,851,157 B2
(45) Date of Patent: Oct. 7, 2014

(54) PARTIAL REVERSE FERRULE HEADER FOR A HEAT EXCHANGER

(75) Inventors: Austin Falkingham, Tea, SD (US); Curt Lindstrom, Sioux Falls, SD (US); Neal Paul, Worthing, SD (US)

(73) Assignee: Adams Thermal Systems, Inc., Canton, SD (US)

( * ) Notice: Subject to any disclaimer, the term of this patent is extended or adjusted under 35 U.S.C. 154(b) by 434 days.

(21) Appl. No.: 12/779,416

(22) Filed: May 13, 2010

(65) Prior Publication Data

US 2011/0277975 A1 Nov. 17, 2011

(51) Int. Cl.

| | |
|---|---|
| ***F28F 9/16*** | (2006.01) |
| ***F28F 9/04*** | (2006.01) |
| ***F28D 1/053*** | (2006.01) |

(52) U.S. Cl.

CPC ..... *F28F 9/04* (2013.01); *F28D 1/05383* (2013.01)

USPC ..... 165/173; 165/178

(58) Field of Classification Search

USPC ..... 165/173, 178

See application file for complete search history.

(56) References Cited

U.S. PATENT DOCUMENTS

| | | | | |
|---|---|---|---|---|
| 1,744,932 | A * | 1/1930 | Swank | 285/192 |
| 1,929,365 | A | 10/1933 | Mautsch | |
| 2,349,792 | A * | 5/1944 | Rosenblad | 285/15 |
| 2,488,627 | A | 11/1949 | Hisey | |
| 2,573,161 | A | 10/1951 | Tadewald | |
| 3,245,465 | A | 4/1966 | Young | |
| 4,150,556 | A | 4/1979 | Melnyk | |
| 4,234,041 | A | 11/1980 | Melnyk | |
| 4,400,965 | A | 8/1983 | Schey | |
| 4,678,112 | A | 7/1987 | Koisuka | |
| 4,730,669 | A | 3/1988 | Beasely | |
| 4,771,825 | A | 9/1988 | Chen | |
| 5,036,913 | A | 8/1991 | Murphy | |
| 5,228,512 | A | 7/1993 | Bretl | |
| 5,301,748 | A | 4/1994 | Potier | |

(Continued)

FOREIGN PATENT DOCUMENTS

| | | |
|---|---|---|
| DE | 19757034 | 6/1999 |
| DE | 10016029 | 10/2001 |
| EP | 0990868 | 7/2000 |
| FR | 2764054 | 8/1999 |

OTHER PUBLICATIONS

PCT International Search Report, Blaine R. Copenheaver, Aug. 2, 2011.

*Primary Examiner* — Leonard R Leo

(74) *Attorney, Agent, or Firm* — Jeffrey A. Proehl; Woods, Fuller, Shultz & Smith, P.C.

(57) ABSTRACT

A header for a heat exchanger having spaced manifolds and tubes extending between the manifolds is disclosed. The header plate comprises a header plate forming a portion of the manifold and having an outward surface for orienting away from the interior of the manifold. At least one opening is formed in the header plate, and is elongated with a longitudinal axis and opposite ends. The at least one opening has a perimeter with sides and ends. A ferrule extends from the outward surface of the header plate along portions of the perimeter of the opening. The ferrule includes at least two ferrule portions formed along portions of the perimeter of the opening. The ferrule is absent from portions of the perimeter of the opening between the portions of the perimeter having the ferrule portions formed thereon.

15 Claims, 4 Drawing Sheets

(56) References Cited

U.S. PATENT DOCUMENTS

| | | | | |
|---|---|---|---|---|
| 5,318,113 | A | 6/1994 | Potier | |
| 5,327,959 | A | 7/1994 | Saperstein | |
| 5,329,988 | A | 7/1994 | Juger | |
| 5,366,006 | A | 11/1994 | Lu | |
| 5,423,112 | A | 6/1995 | Murphy | |
| 5,605,191 | A | 2/1997 | Eto et al. | |
| 5,787,973 | A | 8/1998 | Kado | |
| 5,918,667 | A * | 7/1999 | Chiba et al. | 165/178 |
| 6,263,570 | B1 | 7/2001 | Cazacu | |
| 7,036,570 | B2 | 5/2006 | Korth | |
| 7,089,998 | B2 | 8/2006 | Crook | |
| 7,156,164 | B2 | 1/2007 | Helms | |
| 7,172,016 | B2 * | 2/2007 | Meshenky et al. | 165/173 |
| 7,413,006 | B2 | 8/2008 | DeGroot | |
| 2007/0000657 | A1 | 1/2007 | Emrich | |
| 2007/0131385 | A1 | 6/2007 | Misiak | |
| 2008/0121388 | A1 * | 5/2008 | Auchter et al. | 165/178 |

* cited by examiner

PARTIAL REVERSE FERRULE HEADER FOR A HEAT EXCHANGER

BACKGROUND

1. Field

The present disclosure relates to heat exchangers and more particularly pertains to a new partial reverse ferrule header for a heat exchanger.

2. Description of the Prior Art

Heat exchangers exchange heat between a first fluid flow and a second fluid flow, with the heat exchanger maintaining a separation between the fluid flows, and typically include manifolds that are connected by conduits that fluidly connect the interiors of the manifolds.

SUMMARY

The present disclosure describes a new partial reverse ferrule header for a heat exchanger which may be utilized, for example, to permit the mounting of multiple tubes in the same opening of a header plate.

The present disclosure relates to a header for a heat exchanger that has a pair of spaced manifolds and a plurality of tubes extending between the manifolds. The header plate comprises a header plate that forms a portion of the manifold and that has an inward surface for orienting toward an interior of the manifold as well as an outward surface for orienting away from the interior of the manifold. At least one opening is formed in the header plate. The at least one opening is elongated with a longitudinal axis and opposite ends, and the at least one opening has a perimeter with sides and ends. A ferrule extends from the outward surface of the header plate along portions of the perimeter of the opening. The ferrule includes at least two ferrule portions formed along portions of the perimeter of the opening. The ferrule is absent from portions of the perimeter of the opening between the portions of the perimeter having the ferrule portions formed thereon.

In another aspect, the disclosure relates to a heat exchanger that comprises a pair of manifolds, with the manifolds being spaced from each other and each having an interior, and a plurality of tubes extending between and connecting the manifolds. The plurality of tubes fluidly connects the interiors of the manifolds. Each of the manifolds comprises a cover and a header plate mounted to the cover to define the interior of the manifold. The plurality of tubes is mounted on the header plate. The header plate has an inward surface for orienting toward an interior of the manifold and an outward surface for orienting away from the interior of the manifold. At least one opening is formed in the header plate to accept at least one of the tubes, and the at least one opening is elongated with a longitudinal axis and opposite ends. The at least one opening has a perimeter with sides and ends. A ferrule extends from the outward surface of the header plate along portions of the perimeter of the opening, the ferrule including at least two ferrule portions formed along portions of the perimeter of the opening. The ferrule is absent from portions of the perimeter of the opening between the portions of the perimeter having the ferrule portions formed thereon.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present invention.

The advantages of the various embodiments of the present invention, along with the various features of novelty that characterize the invention, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

With reference now to the drawings, and in particular to FIGS. 1 through 7 thereof, a new partial reverse ferrule header for a heat exchanger embodying the principles and concepts of the disclosed subject matter will be described.

The development described in this disclosure is highly suitable for incorporation into a heat exchanger 10 employed to exchange heat between a first fluid flow and a second fluid flow, with the heat exchanger maintaining a separation between the fluid flows. In the following description, the illustrative embodiment of the disclosure is a charge air cooler for exchanging heat between a first air flow and a second air flow, although it will be appreciated by those skilled in the art that the application of the disclosure is not limited to this particular application, and may be employed on other types of heat exchangers with other purposes.

Figure 1:
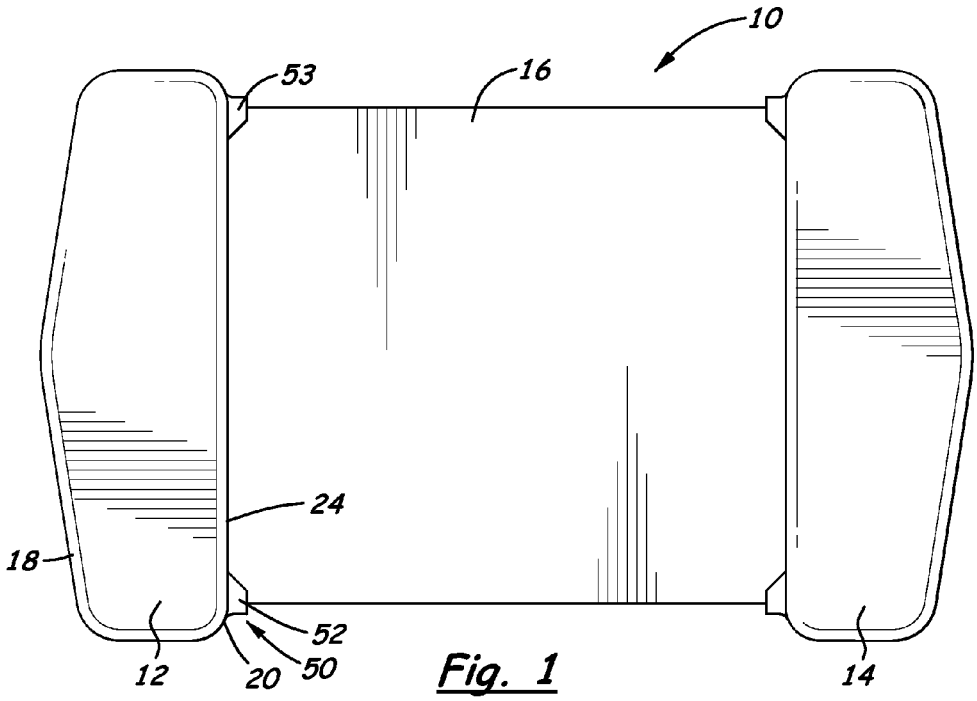
FIG. 1 is a schematic side view of a heat exchanger assembly including aspects of a new partial reverse ferrule header according to the present disclosure.
Figure 2A:
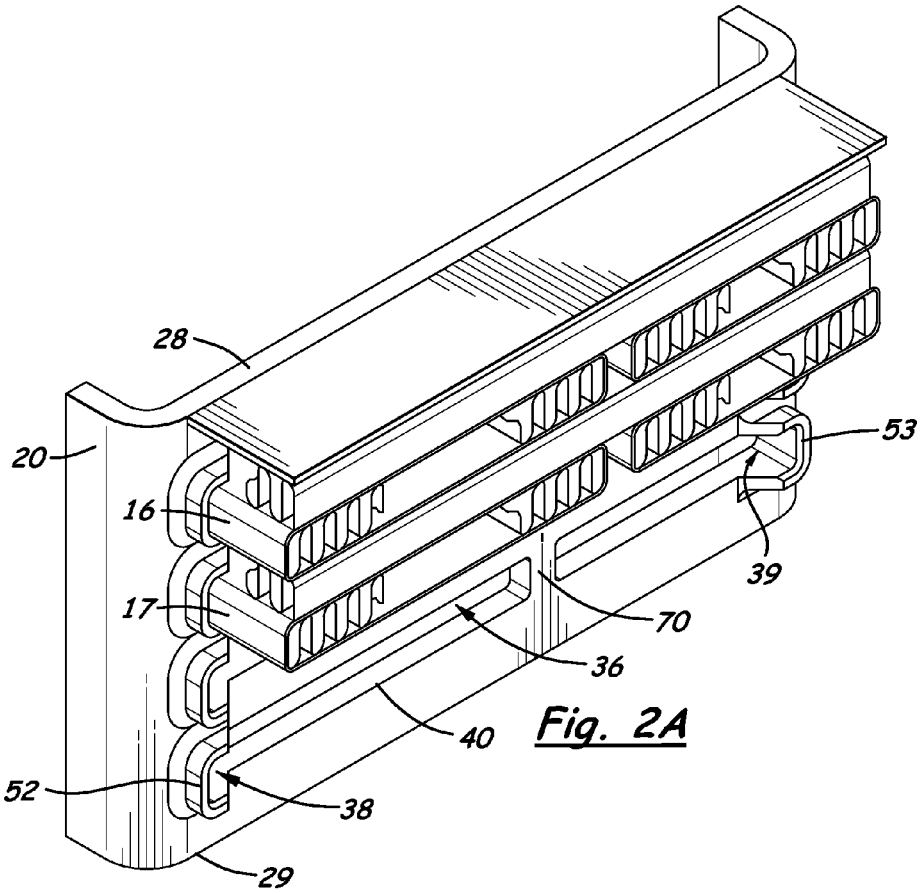
FIG. 2A is a schematic perspective view of the header plate with the cover removed and with portions of the tubes mounted on the header plate and other tubes removed from the header plate to reveal detail of the partial reverse ferrule structures and a web extending across the opening.
Figure 2B:
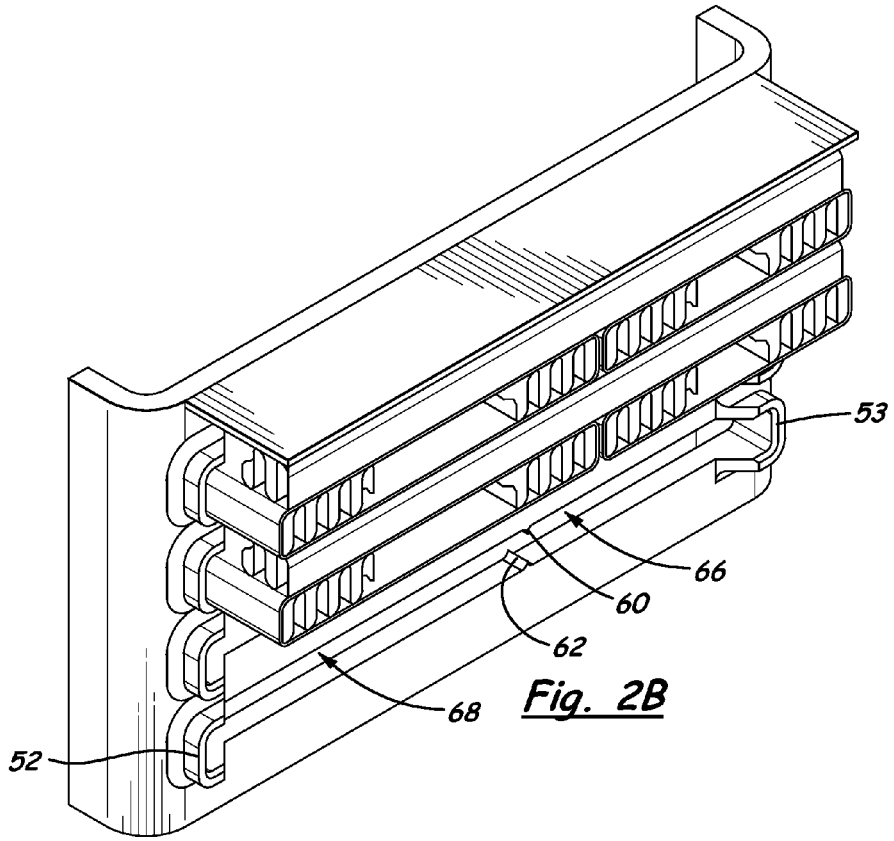
FIG. 2B is a schematic perspective view of the header plate with the cover removed and with portions of the tubes mounted on the header plate and other tubes removed from the header plate to reveal detail of the partial reverse ferrule structures and protrusions extending into the opening.

In the illustrative embodiments, such as is illustrated in FIG. 1, the heat exchanger 10 may comprise a pair of manifolds, including a first manifold 12 and a second manifold 14, that are spaced from each other. Each of the manifolds 12, 14 defines an interior 15 for receiving the first fluid. The heat exchanger may further comprise at least one tube, and typically a plurality of tubes, extending between and connecting the manifolds 12, 14. The plurality of tubes 16 fluidly connect the interiors 15 of the manifolds so that the first fluid is able to pass from one manifold to the other manifold, and in some cases, back to the original manifold. For the purposes of this disclosure, a first tube 16 and a second tube 17 will be described with the understanding that other tubes may be employed and may have similar characteristics.

Figure 3:
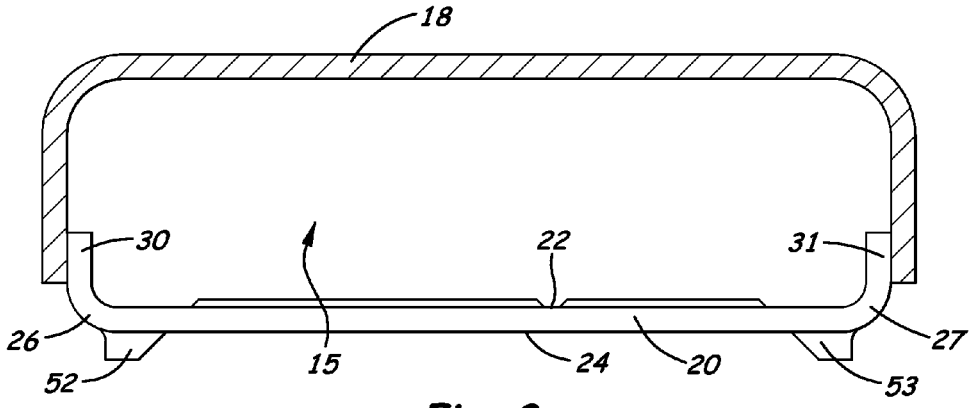
FIG. 3 is a schematic side edge view of the header plate according to an illustrative embodiment.

At least one of the manifolds, and preferably (but not critically) both of the manifolds, comprises a cover 18 and a header 20 that is mounted to the cover to define the interior 15 of the respective manifold (see FIGS. 1 and 3). The header 20 may be embodied as a plate formed of a piece of sheet material with a substantially uniform thickness that is formed and contoured in a suitable manner to include the features of the header. The plurality of tubes 16 are mounted on the header plate 20 in a manner described in greater detail below. The header plate 20 has an inward surface 22 for orienting toward the interior 15 of the manifold and an outward surface 24 for orienting away from the interior of the manifold, and toward the other manifold of the pair of manifolds. The header plate 20 is typically elongate with opposite ends 26, 27 and opposite sides 28, 29 that extend between the opposite ends. The header plate 20 may have lip portions 30, 31 that are formed at the opposite ends of the plate 20, although this feature is not critical.

The header plate 20 has at least one opening 36 therein for accepting a portion of one or more tubes 16, and typically the header plate will includes a plurality of openings to accept the plurality of tubes (see FIG. 2). One of the openings will be described with the understanding that the other openings in the header plate are preferably, but not critically, similar in nature.

Figure 4:
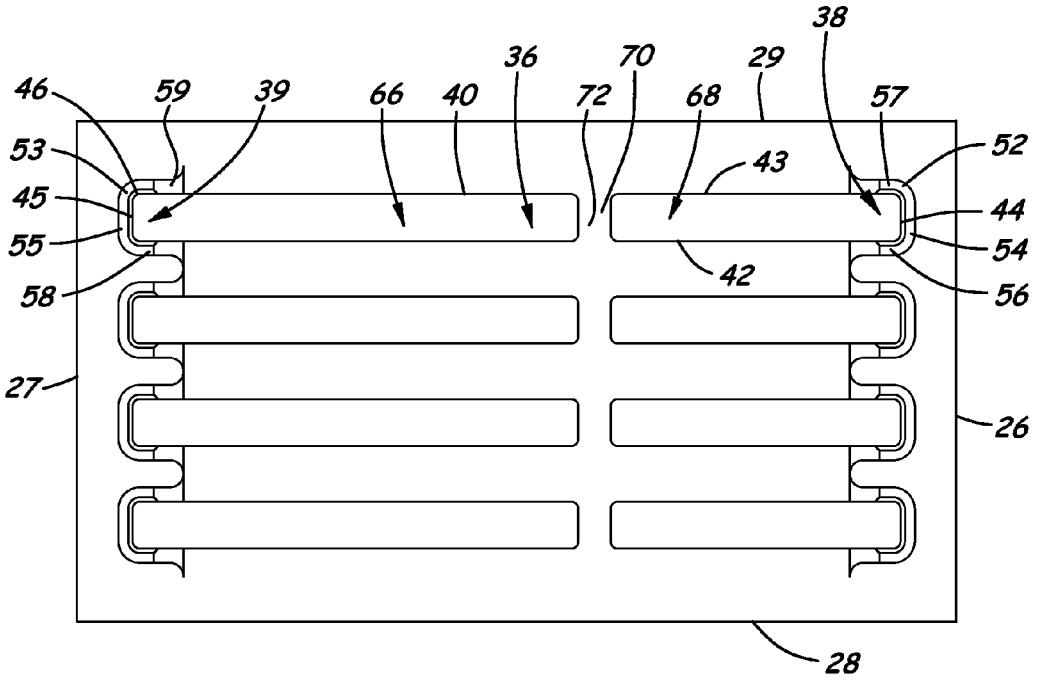
FIG. 4 is a schematic plan view of the header plate, according to an illustrative embodiment.
Figure 5:
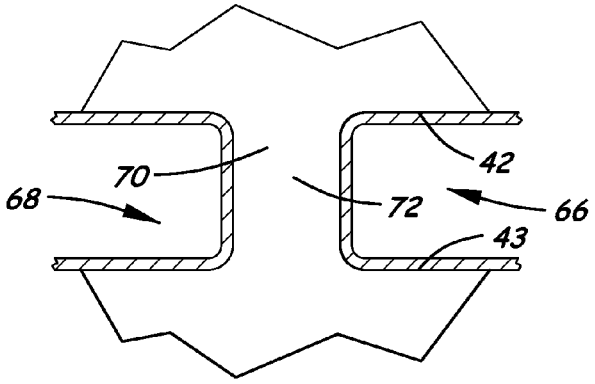
FIG. 5 is a schematic enlarged view of a portion of the header plate showing the protrusions on the opening, according to the illustrative embodiment of FIG. 4.

The opening 36 may be elongated in shape with a longitudinal axis extending between the ends 38, 39 of the opening (see FIG. 4). The opening 36 may have a perimeter 40 with longitudinally-extending sides 42, 43 and substantially transversely extending ends 44, 45. In some embodiments, the sides 42, 43 of the perimeter are oriented substantially parallel to each other. In some embodiments, the ends 44, 45 of the perimeter are oriented substantially parallel to each other. And in some embodiments, the juncture 46 between the respective sides and ends of the perimeter is characterized by a rounded, radiused section of the perimeter.

A ferrule 50 is formed along portions of the perimeter 40 of the opening 36 (see FIGS. 2 and 4). The ferrule 50 is located adjacent to the perimeter 40 of the opening 36, and may be located at the edge of the opening 36. In greater detail, the ferrule 50 may extend from the outward surface 24 of the header plate 20, and may comprise a raised surface that is raised above the plane of the outward surface 24 of the major portion or majority of the header plate 20. In some preferred embodiments, the ferrules 50 are formed from the same piece of material that forms the header plate 20, although this is not critical. The structure of the ferrule may be formed by forming the ferrule portions from the material of the header plate during forming operations, or the material forming the ferrule may be added to the header plate and integrated therewith.

Significantly, the ferrule 50 is not present at all portions of the opening, and is thus absent or missing from portions of the perimeter 40 of the opening (see FIG. 3). The ferrule 50 may have two portions 52, 53, and the portions may be positioned at opposite locations on the perimeter 40 of the opening 36. The portions 52, 53 may be positioned in opposition to each other, and may be positioned toward the ends 44, 45 of the elongated opening 36.

Each of the ferrule portions 52, 53 may have an end section 54, 55 that extends along the respective one of the ends 38, 39 of the opening 36 (see FIG. 4). Each of the ferrule portions 52, 53 may also have a section that extends along a portion of one of the sides 42, 43 of the perimeter 40 of the opening. In some preferred embodiments, each of the ferrule portions 52, 53 has a section that extends along portions of both sides of the opening. The side sections of the ferrule portions may be joined to the respective end sections of the same ferrule portion. Illustratively, the first portion 52 of the ferrule may include a first side section 56 and a second side section 57, and these sections 56, 57 may be attached to and may extend from the first end section 54 of the first ferrule portion. Similarly, but not necessarily identically, the second portion 53 of the ferrule may include a first side section 58 and a second side section 59, and these sections 58, 59 may be attached to and may extend from the second end section 55 of the second ferrule portion. Thus, each of the ferrule portions 52, 53 may have a substantially U-shaped configuration.

In some embodiments, the side sections 56, 57, 58, 59 of the ferrule portions may extend along less than approximately 40% of the total length of the side 42, 43 of the perimeter 40, and in some further embodiments may extend less than 25% of the total length, and in some further embodiments may extend less than 10% of the total length. In the illustrative embodiments, the height of a portion of the side sections 56, 57, 58, 59 above the outward surface 24 of the header plate taper shorter toward the center of the header plate, while a portion of the side sections may have a height that is uniform with the end sections.

Another significant aspect of the disclosure is particularly useful in embodiments where more than one tube is positioned in the same opening 36 in the header plate 20 (such as is shown in FIG. 2), especially for closing the gap or gaps between the adjacent tubes in the opening. The following illustrative descriptions will be directed to illustrative embodiments in which two tubes are positioned in the same openings, although the features may be employed in embodiments with more than two tubes positioned in the same opening.

Figure 6:
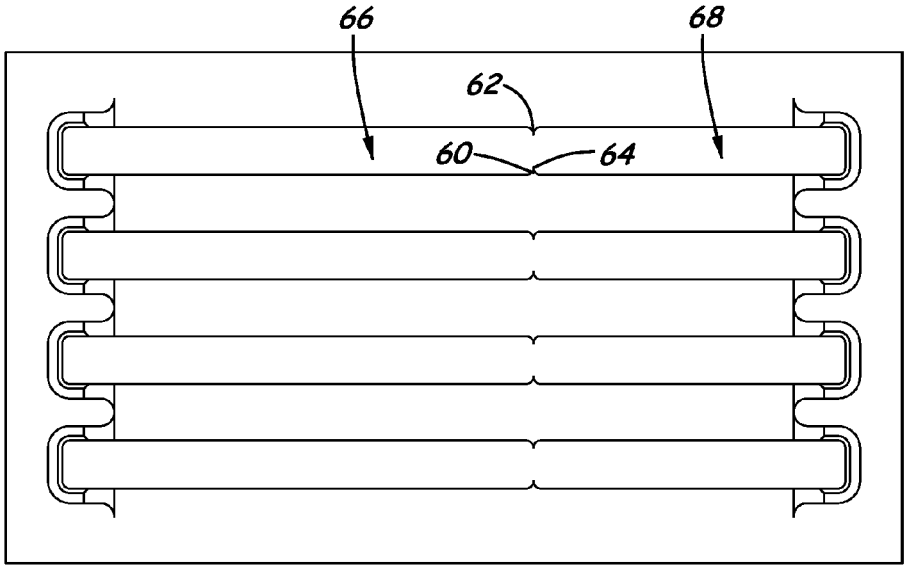
FIG. 6 is a schematic plan view of the header plate, according to another illustrative embodiment.

One variation of this feature is illustratively shown in FIG. 6, where a protrusion 60 extends from at least one side of the perimeter 40 of the opening. In some of the most preferred embodiments, a protrusion is located on each side 42, 43 of the perimeter of the opening, so that the first protrusion 60 extends from the first side 42 of the perimeter and a second protrusion 62 extends from the second side 43 of the perimeter. The protrusions 60, 62 may extend toward each other from the sides 42, 43, and may be in opposition to each other across the opening. The protrusions 60, 62 may extend a portion or fraction of the distance between the sides 42, 43 of the perimeter of the opening, but may not touch and the nearest extents of the protrusions 60, 62 may be spaced from each other. In some embodiments, each of the protrusions each extend less than approximately 40% of the distance between the sides 42, 43 of the perimeter, and in some further embodiments may extend less than 25% of the distance, and in some further embodiments may extend less than 10% of the distance.

Figure 7:
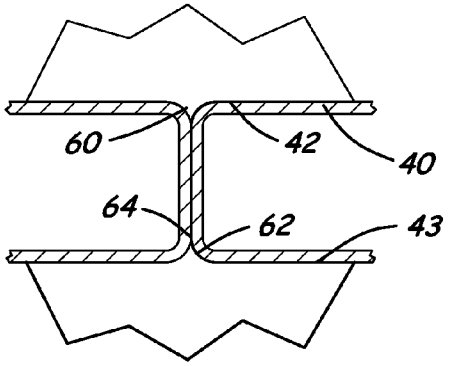
FIG. 7 is a schematic enlarged view of a portion of the header plate showing the web on the opening, according to the illustrative embodiment of FIG. 6.

The protrusions 60, 62 may have similar shapes that taper narrower from the respective side 42, 43 toward a tip 64 of the protrusion (see FIG. 7). The tip 64 of the protrusion may be characterized as being a pointed tip. Further, the edges of the material forming the portion of the protrusion adjacent to the side of the perimeter may be rounded or radiused to more closely fit against the exterior of a tube that is rounded at the location of the protrusion.

Another variation of this feature is illustratively shown in FIG. 4, where a web 70 of material extends between the sides 42, 43 of the perimeter 40 of the opening. The web 70 may be continuous and unbroken between the sides 42, 43, and may be formed of the same piece of material that forms the remainder of the header plate 20, although that is not critical. The web 70 may thus connect the sides 42, 43 of the opening.

The web 70 may be located between, and may be spaced from, the ends 38, 39 of the opening 36. The web 70 may divide the opening 36 into portions, such as, for example, a first portion 66 and a second portion 68. It will be recognized that where multiple webs 70 are employed, more than two portions of the opening may be formed. The two opening portions 66, 68 may be positioned between the ferrule portions 52, 53. The areas of the opening portions 66, 68 may be different, or may be the same or substantially the same. The web 70 has an outer surface 72, which may be substantially coplanar with the outward surface 24 of the header plate 20 (see FIG. 3). The areas of the web 70 where the web meets the sides 42, 43 of the perimeter may have radiused edges to more closely fit against the exterior of a tube that is rounded at the location of the web (see FIG. 5).

It will be recognized that in embodiments employing the protrusions 60, the tubes 16, 17 in the opening may be positioned relatively close together, and may be in contact with each other. In embodiments employing the web 70, the tubes 16, 17 in the opening may be spaced from each other by the web (see FIGS. 2A and 2B).

The utilization of a ferrule increases the durability of the connection between the tubes and the header plate and extends the life of the heat exchanger, and the inclusion of the partial reverse ferrule aspect of the disclosure facilitates the positioning of two (or more) tubes in the same opening between the portions of the ferrule located at the opposite ends of the opening. More specifically, the absence of the ferrule in the areas between the ferrule portions permits the formation of the protrusion 60 and/or the web 70 in the space between the ferrule portions. The protrusions or webs function to provide a closer and better fit up against the curvature of the exterior surfaces of the tubes positioned in the opening. Two or more tubes may be utilized within a single opening where the width of the cross section of each tube is limited, such as in applications where a tube formed by welding is used as compared to a tube formed by, for example, extrusion. Using aspects of the disclosure, two or more welded tubes may be used in the same opening to increase the depth of the heat exchanger, and therefore depths comparable to those depths possible with the use of a single extruded tube are possible. Benefits for utilizing a welded tube rather than an extruded tube include the ability to use a higher strength alloy for the wall of the welded tube (as compared to an extruded tube), which may permit the use of a thinner wall thickness for the tube. For example, the wall thickness of a welded tube may be approximately one-half of the wall thickness of an extruded tube. In turn, the benefits of utilizing a tube with a thinner wall thickness are the use of less material, better heat transfer between the fluid flowing within the tube and the fluid flowing over the exterior of the tube, and a larger inside diameter for the tube to decrease the pressure drop experienced by the fluid flowing through the interior of the tube, as well as other possible benefits.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A header for a heat exchanger having a pair of spaced manifolds and a plurality of tubes extending between the manifolds, the header comprising:

a header plate forming a portion of the manifold, the header plate having an inward surface for orienting toward an interior of the manifold and an outward surface for orienting away from the interior of the manifold;

wherein a plurality of openings is formed in the header plate, each opening being elongated with a longitudinal axis and opposite ends, each opening has a perimeter with sides, a web of material extending between and connecting the sides of the perimeter of at least one opening, the web being located between and spaced from the opposite ends of the opening to divide the opening into at least two opening portions extending along the longitudinal axis of the elongated opening;

wherein a ferrule extends from the outward surface of the header plate along portions of the perimeter of each of the openings of the header plate;

wherein the ferrule for each opening includes two ferrule portions positioned in opposition to each other at the opposite ends of the opening; and wherein the ferrule for each opening is absent from portions of the perimeter of the opening between the opposite ends of the opening;

wherein, for a said opening, only one said ferrule portion is positioned on a first one of the opening portions and only one said ferrule portion is positioned on a second one of the opening portions.

2. The header of claim 1 wherein the web of material is free of any ferrule portion.

3. The header of claim 1 wherein each of the ferrule portions are positioned toward ends of the opening portions.

4. The header of claim 1 wherein each of the ferrule portions has a section extending along one of the ends of the opening and sections that extend along portions of the sides of the opening.

5. The header of claim 4 wherein the sections of the ferrule portions along the sides of the perimeter of the opening extend along less than 40% of a length of the side.

6. The header of claim 1 wherein each of the ferrule portions has a U-shaped configuration, and the ferrule portions are positioned in opposition to each other.

7. The header of claim 1 wherein the web of material is located between the two ferrule portions at the opposite ends of the opening.

8. A header for a heat exchanger having a pair of spaced manifolds and a plurality of tubes extending between the manifolds, the header comprising:

a header plate forming a portion of the manifold, the header plate having an inward surface for orienting toward an interior of the manifold and an outward surface for orienting away from the interior of the manifold;

wherein a plurality of openings is formed in the header plate, each opening being elongated with a longitudinal axis and opposite ends, each opening has a perimeter with sides, a web of material extending between and connecting the sides of the perimeter of at least one opening, the web being located between and spaced from the opposite ends of the opening to divide the opening into at least two opening portions extending along the longitudinal axis of the elongated opening;

wherein a ferrule extends from the outward surface of the header plate along portions of the perimeter of each of the openings of the header plate;

wherein the ferrule for each opening includes two ferrule portions positioned in opposition to each other at the opposite ends of the opening;

wherein the ferrule for each opening is absent from portions of the perimeter of the opening between the opposite ends of the opening;

wherein the opening portions of the each opening each include ends, inner said ends of the opening portions of a said opening being located adjacent to the web of material and outer said ends of the opening portions of said opening forming the opposite ends of the opening; and wherein the inner ends of the opening portions are free of any ferrule portions.

9. The header of claim 8 wherein the web of material is free of any ferrule portion.

10. The header of claim 8 wherein each of the ferrule portions has a U-shaped configuration, and the ferrule portions are positioned in opposition to each other.

11. The header of claim 8 wherein the web of material is located between the two ferrule portions at the opposite ends of the opening.

12. The header of claim 8 wherein a tube of the plurality of tubes is positioned in each of the portions of the opening with the web being positioned between the two tubes.

13. The header of claim 8 wherein each of the ferrule portions has a section extending along one of the ends of the opening and sections that extend along portions of the sides of the opening; and wherein the sections of the ferrule portions along the sides of the perimeter of the opening extend along less than 40% of a length of the side.

14. The header of claim 8 wherein, for a said opening, only one said ferrule portion is positioned on a first one of the opening portions and only one said ferrule portion is positioned on a second one of the opening portions.

15. A header for a heat exchanger having a pair of spaced manifolds and a plurality of tubes extending between the manifolds, the header comprising:

a header plate forming a portion of the manifold, the header plate having an inward surface for orienting toward an interior of the manifold and an outward surface for orienting away from the interior of the manifold;

wherein a plurality of openings is formed in the header plate, each opening being elongated with a longitudinal axis and opposite ends, each opening has a perimeter with sides, a web of material extending between and connecting the sides of the perimeter of at least one opening, the web being located between and spaced from the opposite ends of the opening to divide the opening into at least two opening portions extending along the longitudinal axis of the elongated opening;

wherein a ferrule extends from the outward surface of the header plate along portions of the perimeter of each of the openings of the header plate;

wherein the ferrule for each opening includes two ferrule portions positioned in opposition to each other at the opposite ends of the opening;

wherein the ferrule for each opening is absent from portions of the perimeter of the opening between the opposite ends of the opening;

wherein the web of material is free of any ferrule portion;

wherein each of the ferrule portions are positioned toward ends of the opening portions;

wherein each of the ferrule portions has a U-shaped configuration, and the ferrule portions are positioned in opposition to each other;

wherein the web of material is located between the two ferrule portions at the opposite ends of the opening;

wherein, for a said opening, only one said ferrule portion is positioned on a first one of the opening portions and only one said ferrule portion is positioned on a second one of the opening portions;

wherein the opening portions of the each opening each include ends, inner said ends of the opening portions of a said opening being located adjacent to the web of material and outer said ends of the opening portions of said opening forming the opposite ends of the opening; and wherein the inner ends of the opening portions are free of any ferrule portions.

* * * * *